United States Patent [19]

Kuchenbecker

[11] Patent Number: 4,592,914

[45] Date of Patent: Jun. 3, 1986

[54] TWO-BLANK DISPOSABLE CONTAINER FOR MICROWAVE FOOD COOKING

[75] Inventor: Morris W. Kuchenbecker, Neenah, Wis.

[73] Assignee: James River-Dixie/Northern, Inc., Greenwich, Conn.

[21] Appl. No.: 504,388

[22] Filed: Jun. 15, 1983

[51] Int. Cl.[4] ..... B65D 81/34; B65D 5/00

[52] U.S. Cl. ..... 426/107; 426/113; 426/118; 426/124; 426/122; 219/10.55 E; 229/9; 229/DIG. 14; 229/3.5 MF; 206/45.15; 220/410

[58] Field of Search ..... 426/107, 113, 234, 243, 426/124, 115, 122, 123, 118; 219/10.55 E; 229/9, 10, 19, DIG. 14, 3.5 MF; 206/583, 45.15; 220/410

[56] References Cited

U.S. PATENT DOCUMENTS

| | | | |
|---|---|---|---|
| 2,001,561 | 5/1935 | Anglin | 229/19 |
| 2,406,254 | 8/1946 | Ringler | 229/34 A |
| 2,617,577 | 11/1952 | Tardiff | 229/19 |
| 3,013,886 | 12/1961 | Lowe | 426/124 |
| 3,158,491 | 11/1964 | Farrell et al. | 426/122 |
| 3,392,902 | 7/1968 | Donovan | 426/124 |
| 3,458,109 | 7/1969 | Compton et al. | 229/9 |
| 3,650,383 | 3/1972 | Nigro | 426/124 |
| 3,721,803 | 3/1973 | DiStefano | 426/113 |
| 3,759,720 | 9/1973 | Young | 426/124 |
| 3,865,301 | 2/1975 | Pothier | 426/107 |
| 3,876,131 | 4/1975 | Tolaas | 426/113 |
| 3,924,013 | 12/1975 | Kane | 426/234 |
| 3,941,967 | 3/1976 | Sumi et al. | 219/10.55 E |
| 3,944,129 | 3/1976 | McCall et al. | 229/DIG. 14 |
| 3,976,241 | 8/1976 | Bemiss | 229/33 |
| 4,015,085 | 3/1977 | Woods | 426/107 |
| 4,065,583 | 12/1977 | Ahlgren | 426/107 |
| 4,081,646 | 3/1978 | Goltsos | 426/107 |
| 4,096,948 | 6/1978 | Kuchenbecker | 426/113 |
| 4,122,324 | 10/1978 | Falk | 219/10.55 E |
| 4,190,757 | 2/1980 | Turpin et al. | 426/107 |
| 4,228,945 | 10/1980 | Wysocki | 426/122 |
| 4,230,924 | 10/1980 | Brastad et al. | 426/107 |
| 4,237,171 | 12/1980 | Laage et al. | 426/127 |
| 4,260,060 | 4/1981 | Faller | 426/113 |
| 4,267,420 | 5/1981 | Brastad | 426/107 |
| 4,279,374 | 7/1981 | Webinger | 426/113 |
| 4,283,427 | 8/1981 | Winters et al. | 426/107 |
| 4,292,332 | 9/1981 | McHam | 426/113 |
| 4,345,133 | 8/1982 | Cherney et al. | 426/107 |
| 4,355,757 | 10/1982 | Roccaforte | 229/DIG. 14 |
| 4,360,107 | 11/1982 | Roccaforte | 426/122 |

FOREIGN PATENT DOCUMENTS

| | | | |
|---|---|---|---|
| 802806 | 6/1935 | France | 229/9 |

*Primary Examiner*—Steven Weinstein

*Attorney, Agent, or Firm*—Sixbey, Friedman & Leedom

[57] ABSTRACT

A two piece container (2) for cooking food in a microwave oven including an outer package (4, 60) formed from a single blank having a removable section (8, 72, 74, 80c) for exposing water vapor ventilation holes and an inner food supporting tray (6, 48). In one embodiment, the inner food supporting tray (6) is formed from a single blank and having V-shaped support legs (44 and 46) to raise the food supporting surface (38) above the surface of the outer package. The material from which the outer package is made has a vapor absorptive characteristic. The inner food supporting tray (6, 48) is completely coated on one side with a microwave absorptive material for heating up to brown or crisp the surface of food in contact with the tray (6) and may be, in addition, coated with a stick and grease resistant material. In one embodiment of the outer package (4), a microwave reflective shielding layer is included on an inner top panel (34) to prevent overcooking of the top of food contained within the container. A method for efficiently laminating the microwave reflective layer to paperboard stock for forming the outer package means is also disclosed.

9 Claims, 13 Drawing Figures

FIG. 6.
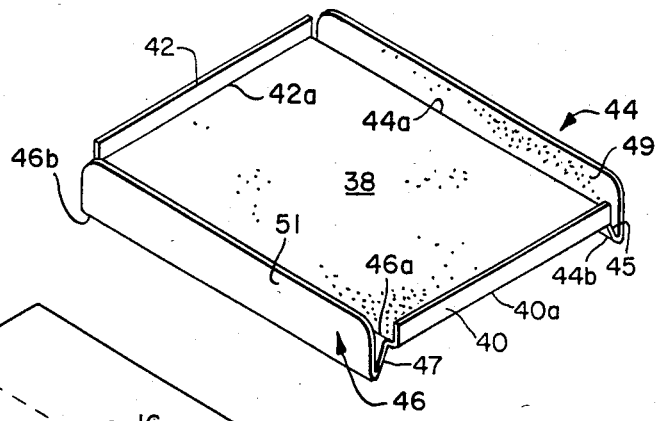
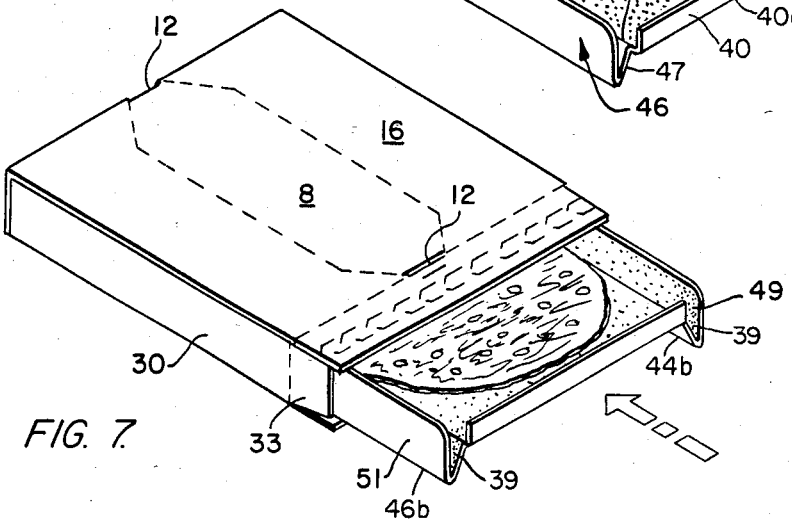
FIG. 7.
FIG. 8.
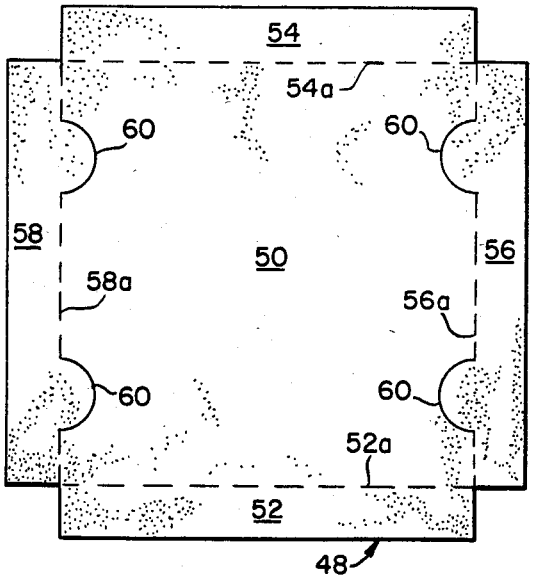

TWO-BLANK DISPOSABLE CONTAINER FOR MICROWAVE FOOD COOKING

TECHNICAL FIELD

This invention relates to a container for cooking food in microwave ovens and particular to a disposable, paperboard container for cooking food, such as pizza, in a microwave oven.

BACKGROUND ART

The development of microwave cooking has had an enormous impact on both commercial and industrial food preparation. The high speed with which cooking occurs and the broad array of materials suitable for use in microwave ovens has created an ever-increasing demand for economical, simple, disposable containers which, when used in a microwave oven, duplicate as closely as possible the cooking results of a conventional oven. Such containers must be capable of serving as a shipping carton which is suitable for display in a supermarket and must be usable as a heating dish by the ultimate consumer. At the same time, it is essential that the container be sufficiently economical to allow it to be disposed after a single use. Paperboard cartons satisfy many of these characteristics but must be designed in accordance with requirements which are dependent on the type and quantity of food to be placed in the container. In the case of pizza, a satisfactorily cooked product must have a crisp crust while avoiding an overcooked, scorched, burned or charred effect. Moreover, the topping of the pizza must be heated properly throughout and must not be dried or burned.

To achieve these goals, a microwave cooking container for pizza needs to allow ventilation of the product as well as air circulation to prevent trapping of excess moisture which might produce a leathery or soggy consistency. An early attempt to produce a paper carton for pizza is illustrated in the patent to Tolaas (U.S. Pat. No. 3,876,131). The carton of this patent is provided with a series of apertures for ventilation which are normally closed by a removable film overlay. While the Tolaas carton functions desirably for its intended purpose, the need to secure the overlay film thereto is undesirable from a manufacturing standpoint. Not only does its application require a separate operation, but it also introduces into the manufacturing procedure the necessity for handling a material unlike that from which the carton body is fabricated, and the use of a film may require the provision of special means to enable facile removal.

The Tolaas patent further teaches the desirability of supporting the pizza above the surface of the microwave oven to achieve a more even cooking of the pizza crust. While the Tolaas carton has structure providing this function, the elevating elements thereof extend beneath the body of the carton in its erected configuration, thus increasing the volume occupied by the carton (such as during transport) and subjecting those elements to possible damage and distortion.

A substantial improvement over the Tolaas carton design and a remedy for many of its deficiencies is disclosed in the patent to Kuchenbecker (U.S. Pat. No. 4,096,948) in which is disclosed a carton having ventilation openings normally closed by a removable panel section. This section is integral with the carton blank eliminating the overlay film problem of Tolaas. Furthermore, by removing the section, two tabs were exposed which could be folded along score lines so as to provide support legs for the carton. This design feature reduced the overall volume of the carton and simplified its shipping requirements. Despite these important steps forward in package integrity and design simplicity, an ideal microwave carton meeting all of the above-described characteristics had not yet been disclosed.

Still another package for producing acceptable pizza from a microwave oven has been disclosed by Turpin, as shown in U.S. Pat. No. 4,190,757. This patent teaches that by placing pizza on a microwave energy absorber such as an interactive layer which converts microwave into heat and inserting holes in the top of a carton having some microwave shielding, a crisp pizza crust could be obtained. However, the package disclosed in Turpin's patent is complicated and expensive to produce. The use of any type of microwave reflective or absorptive material in a paperboard carton always presents the possibility of charring or even burning of the food and/or the paperboard material of which the carton is made. Attempts to avoid the danger of charring of the paperboard have normally resulted in the use of an entirely separate element arranged to be placed between the food and the food support or in a complicated outline for the microwave interactive layer which is different from the outline of the paperboard blank on which the interactive layer is supported such as illustrated in the patent to LePothier (U.S. Pat. No. 3,865,301). These prior designs for the microwave interactive layer can add significantly to the cost of the final carton. Furthermore, it has been discovered that pizza can stick to a microwave interactive layer, making removal difficult. Similar expense and complexity problems have been encountered in producing other types of cartons such as disclosed in the patent to Winters (U.S. Pat. No. 4,283,427) although this patent does suggest a solution to the sticking problem by teaching the application of a substantially grease-resistant material to the top of an insert pouch on which pizza would be cooked. Further disclosure concerning stick-resistant coatings is discussed in the patent to Webinger (U.S. Pat. No. 4,279,374) but this reference in no way suggests solutions to the many other problems associated with producing an ideal microwave pizza carton.

Thus, it has remained an elusive goal in the microwave container art to produce a "cook-in" container for pizza which is inexpensive and simple to manufacture yet still results in a high quality crisp crust pizza that is easily accessible and removable.

DISCLOSURE OF THE INVENTION

It is the primary object of the subject invention to overcome the deficiencies of the prior art by providing a microwave "cook-in" container which is inexpensive and simple to manufacture.

A further object of the invention is to provide a "cook-in" container manufactured from two separate unitary paperboard blanks, one of which forms an outer package while the other forms an inner food supporting tray having a microwave interactive layer for converting a portion of the available microwave energy to heat for browning or crisping the surface of the food.

Still another object of this invention is to provide a simple, inexpensive microwave "cook-in" container for pizza which produces a crisp pizza crust after the cooking process without charring the cooking package and without producing a moist or soggy pizza wherein the container is formed of two separate unitary paperboard blanks with the first blank forming an outer package having a microwave shielding layer supported on the top surface of the blank to prevent overcooking of the top portion of the food product and with the second blank having a microwave interactive layer covering entirely one side of the blank which is cut, scored and folded to form a food supporting tray for spacing the food above the bottom wall of the carton.

Another object of this invention is to provide a release coating for the food holding tray which will facilitate removal of food from the tray after the cooking process is completed.

Yet another object of this invention is to provide a method for making a microwave, cook-in container including the steps of (1) partially erecting an outer package from a first blank to provide two opposite sidewalls and a third side wall containing an opening extending between the two opposite side walls, (2) forming an elevated food support tray from a blank by folding laterally opposed leg flaps into a vertical position separated by a distance slightly less than the separation of the opposite side walls, and (3) inserting the elevated food support tray into the outer package through the opening while using the opposite side walls to prevent collapse of the opposed leg flaps.

Still another object of this invention is to provide a method for laminating a strip of coating material onto elongated paperboard stock from which plural container blanks are to be cut with only a predetermined portion of one side of each blank being covered by the coating material, including the steps of (1) providing elongated paperboard stock of sufficient width to allow at least two rows of blanks to be formed from the stock with the blanks being arranged in side by side relationship in the longitudinal direction of the paperboard stock with the last portions of the blanks in each row being positioned immediately adjacent a corresponding lateral edge of the elongated paperboard stock and (2) laminating two strips of the coating material along the two lateral edges of the paperboard stock to permit the stock to be rolled into a cylindrical form having end portions which are resistant to impact damage.

Yet a further object of this invention is to provide a two piece container for cook-in microwave use including an inner food support tray with V-shaped legs which are retained in position by the side walls of an outer package and have a space to reduce charring between the two sections of the "V" since the width dimension of the food supporting panel is smaller than the corresponding planar width of the outer package.

Other and more specific objects of the invention may be understood from the following Brief Description of the Drawings and Best Mode for Carrying Out the Invention.

BRIEF DESCRIPTION OF THE DRAWINGS

FIG. 6 is a perspective view of an erected food supporting tray formed from the blank of FIG. 5.

FIG. 7 is a perspective view of the food supporting tray of FIG. 6 which has been partially inserted into a previously erected outer package.

FIG. 8 is a top view of a paperboard blank for forming an alternative embodiment of the food supporting tray of the subject invention.

BEST MODE FOR CARRYING OUT THE INVENTION

Figure 1:
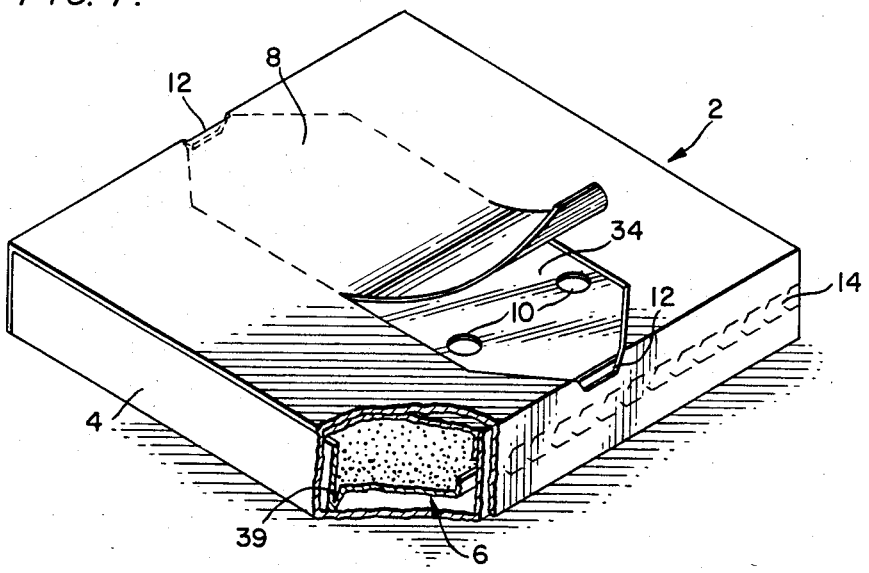
FIG. 1 is a cut away, front perspective view of a microwave "cook-in" container assembly designed in accordance with this invention including an outer package having a removable section illustrated in a partially torn away condition and including a food supporting tray located within the outer package.

For a clear understanding of the subject invention, reference is initially made to FIG. 1 in which a microwave food container assembly 2 designed in accordance with the subject invention is illustrated. In particular, this container assembly includes an outer package 4 formed from a first paperboard blank and an inner food supporting tray 6 formed from a second paperboard blank. The outer package 4 serves to protect the food during shipment and in certain embodiments to shield portions of the food from direct microwave impingement during the cooking process. The outer package 4 includes an integral removable section 8 in the outer top panel of the outer package 4 which is removed prior to insertion into a microwave oven to expose an inner top panel containing several ventilation holes 10. Removal of section 8 is made easier by the provision of finger-holes 12 in opposed ends of the outer package. The outer package 4 also has a perforated tear away strip 14 on one end to facilitate opening of the outer package 4 and removal of cooked food, such as pizza. The inner food supporting tray 6 serves to support the food, such as pizza, in an elevated position above the bottom wall of the outer package 4 and, at the same time, operates to convert a portion of the microwave energy into heat for browning and crisping the surface of the food in contact with the tray.

The unique elements of container assembly 2 will be better understood after an explanation of the production, erection, assembly and various special features of each of the two paperboard blank components making up the container assembly 2.

Figure 2:
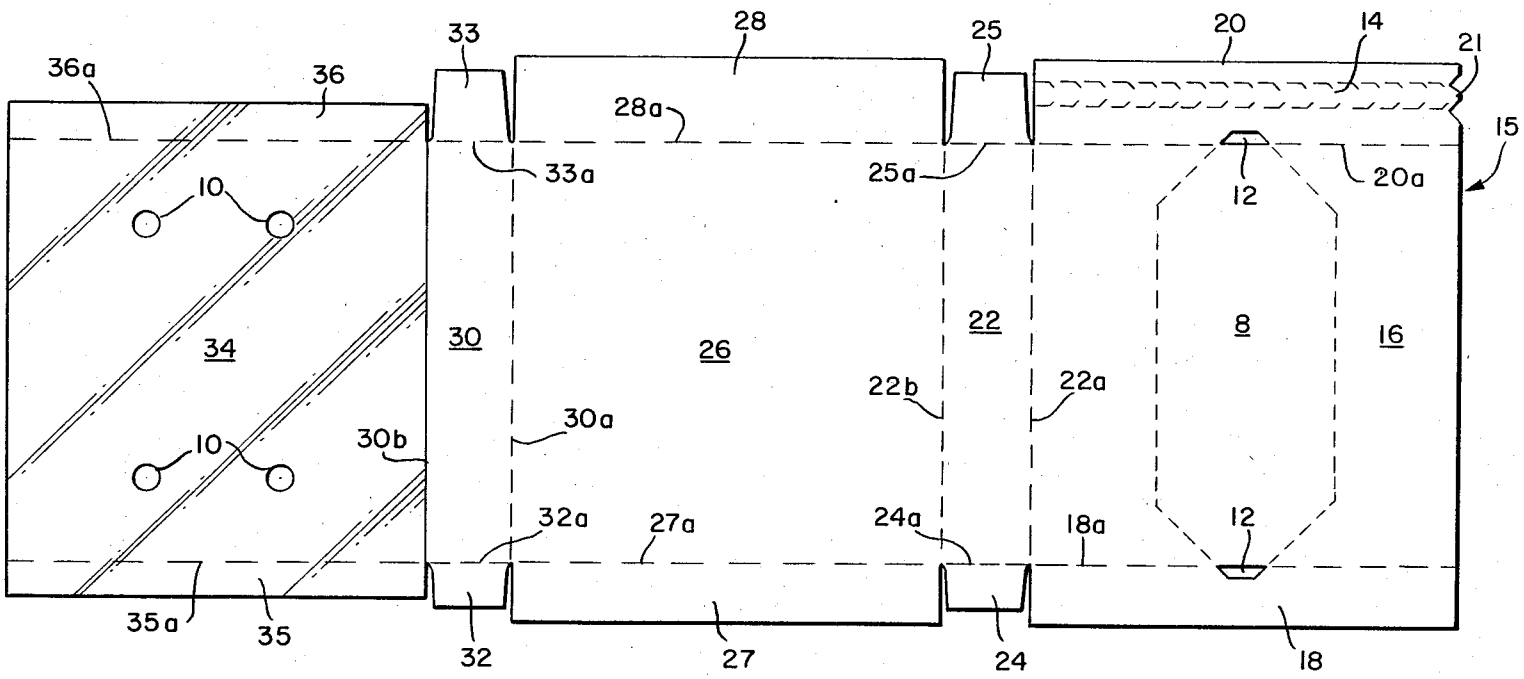
FIG. 2 is a top view of a paperboard blank from which the outer package of FIG. 1 may be formed.

Outer package 4 is formed from a single unitary paperboard blank 15, an elevational view of which is shown in FIG. 2. Paperboard has a number of desirable characteristics which makes it ideally suited as the primary structural component of a disposable cook-in microwave container. In particular, paperboard is strong, microwave transparent, easily adapted to receive advertising display graphics and easily handled during container assembly. All of these advantages combine with its recyclability, biodegradability and, as will be discussed below, its natural inclination to absorb moisture when exposed to steam. Blank 15 includes basically five interconnected panels 16, 22, 26, 30 and 34. Panel 16 which may be referred to as the outer top panel includes the perforated removable section 8 (referred to above with respect to FIG. 1) which is generally octagonally shaped. Two outer end flaps 18 and 20 are connected along fold lines 18*a* and 20*a*, respectively, to outer top panel 16. Outer end flap 20 includes the perforated tear strip 14 which has a starting tab 21. By tearing this strip off of an assembled, sealed container, end flaps 20 and 28 (described below) may be opened and food may be removed from outer package 4. Each outer end flap 18 and 20 includes a trapezoidally shaped fingerhole 12, the longer parallel side of which defines the shortest side of removable section 8 in outer top panel 16. Outer top panel 16 is connected along fold line 22*a* to first side wall panel 22 to which two lateral tabs 24 and 25 are also foldably connected along fold lines 24*a* and 25*a*, respectively. First side wall panel 22 is further foldably connected along fold line 22*b* to bottom panel 26 to which two intermediate end flaps 27 and 28 are foldably attached. Bottom panel 26 is connected along fold line 30*a* with second side wall panel 30 which is the same size as first side wall panel 22 and also has two lateral tabs 32 and 33 foldably connected to it along fold lines 32*a* and 33*a*, respectively. Side wall panel 30 is further connected along fold line 30*b* to inner top panel 34. This last panel contains several significant features. First, there are four round ventilation holes 10 formed in its surface. These holes allow water vapor to escape during the microwave cooking process so that the food product in the container does not become soggy. Second, this panel is coated on its external side, that is the side which will face the outside of the package, after it is assembled, with a microwave reflective material, as indicated by the shaded section of FIG. 2 which may be a layer of aluminum foil approximate 0.00025 inches in thickness. Of course, any other type of material having microwave reflective characteristics may be used. This reflective material is used to minimize the amount of microwave energy striking the top of the pizza placed in the package, thus minimizing the likelihood that the pizza topping will become overcooked, dried or burned when the pizza is left in the microwave for a sufficient time to cook the pizza crust. Finally, blank 15 may also include inner end flaps 35 and 36 which are connected along fold lines 35*a* and 36*a*, respectively, to inner top panel 34. Flaps 35 and 36 are arranged to be folded downwardly into a vertical orientation and may have a vertical height of slightly less than ½ of the vertical height of side wall panels 22 and 30. It should also be noted that the vertical heights of outer end flap 20 and intermediate end flap 28 approximately equal the vertical height of side wall panels 22 and 30 to allow sufficient space for perforated tear strip 14, while the vertical heights of outer end flap 18 and intermediate end flap 27 equal approximately 75 percent of the vertical height of side wall panels 22 and 30 to permit some overlap for sealing without excess wastage of paperboard stock.

Figure 3:
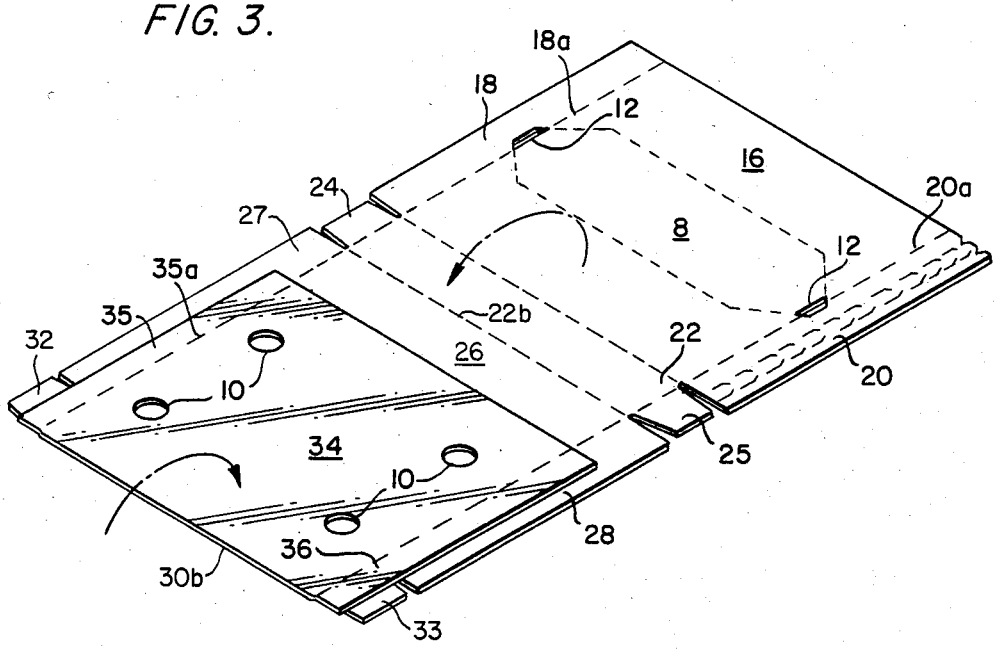
FIG. 3 is a perspective view of the outer package as it is being prepared for shipment in a flattened condition to a point at which it can be erected for use in a container assembly.

The use of a single unitary blank design significantly reduces the complexity of forming the outer package 4 as will now be demonstrated by reference to FIG. 3 which shows a blank being prepared for shipment in a flattened condition to the point of packaging. In this view, the blank of FIG. 2 has been turned over and the inner top panel 34 has been folded 180° along line 30*b* to lie flat against sidewall panel 30 (not illustrated in FIG. 3) and bottom panel 26. Next, outer top panel 16 and side wall panel 22 will be folded 180° along line 22*b* so that outer top panel 16 is brought into overlying contact with inner top wall panel 34. As a result of these operations, panels 16 and 34 may be connected together by use of adhesive, thermoplastic material or other type of suitable mechanical or chemical securing means applied prior to or simultaneously with the folding operations described above. Upon completion of these steps, a flattened tube is formed which may be shipped from the point of manufacture of the outer package to a point of packaging at which the outer package may be erected and food inserted therein for shipment to points of purchase by the ultimate users.

Figure 4:
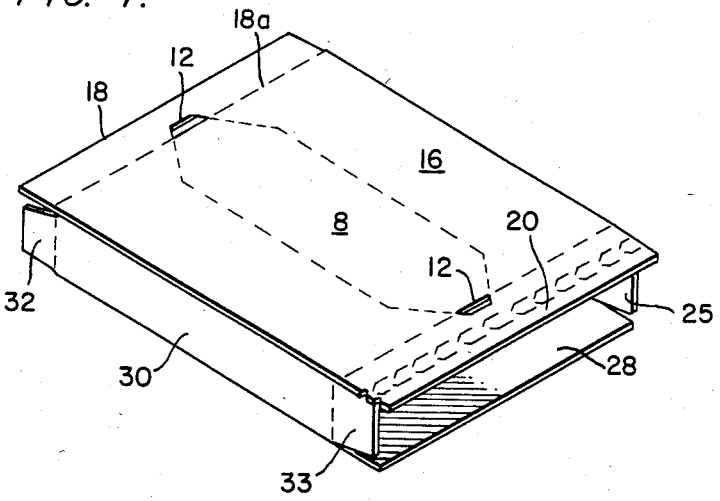
FIG. 4 is a perspective view of the outer package of FIG. 3 after erection at the point of packaging.

FIG. 4 illustrates the configuration of the outer package 4 when it has been erected at the point of packaging in preparation for insertion of an inner food supporting tray 6, to be described below. In order to reach this next stage, the flattened tube resulting from the steps described above is subjected to forces which cause side wall panel 22 (not illustrated in FIG. 4) and side wall panel 30 to assume positions which are perpendicular to panels 16, 26 and 34.

One end of outer package 4 may be closed prior to insertion of the inner food supporting tray 6 although it is entirely possible to leave both ends open until tray 6 has been inserted. If it is desired to close one end prior to tray insertion, this may be done by folding in lateral tabs 24 and 32 along lines 24*a* and 32*a*, respectively. Next, intermediate end flap 27 may be folded upwardly along line 27*a*, and outer end flap 18 may be folded downwardly along line 18*a* to automatically fold down inner end flap 35 and bring the lower portion of end flap 18 into face to face contact with intermediate end flap 27. An adhesive may be applied either to intermediate end flap 27 or to outer end flap 18 or to both flaps prior to closing so that they remain in face to face contact.

Figure 5:
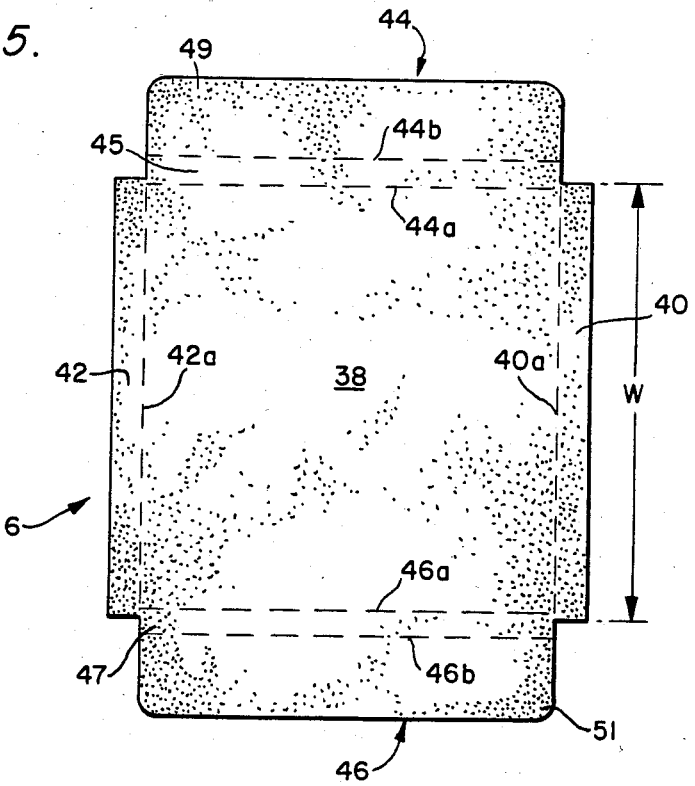
FIG. 5 is a top view of an inner paperboard blank from which the food supporting tray of FIG. 1 may be formed.

Reference is now made to the configuration and method of assembly of the food supporting tray 6. In particular, FIG. 5 provides an elevational view of the single, unitary paperboard blank from which tray 6 is made. The dappling shown in FIG. 5 signifies that one surface of this blank is entirely coated with a layer of microwave interactive material. In particular, this layer of material is designed to convert a substantial portion of the microwaves which impinge upon it into heat, thereby crisping or browning the food surfaces in contact with the tray. The microwave interactive material may be formed from a metallized layer of polyester film. Other types of microwave interactive coatings which heat up to brown or crisp food may be used such as the various coatings, materials and layers discussed in U.S. Pat. No. 4,190,757. An important advantage of the present design, which will be described further below, derives from the fact that the microwave interactive layer covers one entire side of the blank from which the tray is formed. This design allows the entire tray to be cut from paperboard stock which is laminated on one side with the microwave interactive material. This procedure is far less expensive than a forming process which requires that only a portion of the blank be covered with the microwave interactive layer and is certainly less expensive than forming an entirely separate interactive element distinct from the tray blank. The blank for inner food supporting tray 6 may further be coated with a stick and grease resistant material to enable easy removal of cooked foods from that surface.

The blank forming inner food supporting tray 6, when cut from the above described stock, includes a central support panel 38, two laterally opposed barrier flaps 40 and 42, and two laterally opposed, multi-sectioned leg flaps 44 and 46. Central food support panel 38 generally corresponds in shape with bottom panel 26 of the outer package blank 15. However, food support panel 38 has a width dimension which is slightly less than the comparable width dimension of the end opening in outer package 4 shown in FIG. 4 through which the tray is inserted during the assembly process. To erect inner food supporting tray 6, barrier flaps 40 and 42 are folded upwardly along fold lines 40*a* and 42*a*, respectively. These flaps function primarily to reinforce support panel 38 to prevent "bowing", but may also be used to prevent sauce from spilling down onto the bottom panel 26 of outer package 4 during cooking which could make that panel hot and easily torn. One of the flaps 40 or 42, as will be explained below, provides a grip for removing tray 6 from outer package 4 after cooking. Multi-sectioned leg flap 44 is connected to support panel 38 along fold line 44*a* and is subdivided by a second fold line 44*b*, parallel to fold line 44*a*, to form an inner riser section 45 between fold lines 44*a* and 44*b* and an outer riser section 49 connected to the inner riser section 45 along fold line 44*b*. Leg flap 46 is similarly formed with fold lines 46*a* and 46*b* to define an inner riser section 47 and an outer riser section 51. The leg flaps are folded downwardly along lines 44*a* and 46*a*, respectively, and the outer riser section 49 and 51 are folded upwardly along lines 44*b* and 46*b*, respectively. As illustrated in FIG. 6, the resulting legs are V-shaped and function to space central food support panel 38 above bottom panel 26 by the vertical height of the inner riser sections 45 and 47 defined by the distance between fold lines 44*a* and 44*b* on one side and the distance between fold lines 46*a* and 46*b* on the other side. The vertical height of the outer riser sections 49 and 51 is approximately equal to the height of outer package 4, as defined by first side wall panel 22 and second side wall panel 30.

FIG. 6 gives a perspective view of an erected inner food supporting tray 6. As is apparent in Fig. 6, fold lines 44*b* and 46*b* form tray runners which function similarly to the runners of a sled.

To complete the assembly of a container in accordance with this invention, food, such as a pizza, is placed on the supporting tray 6. Next, the tray 6 is oriented so that the two V-shaped legs 44 and 46 are parallel to the side wall panels 22 and 30 of outer package 4. Then, inner food supporting tray 6 is slid into outer package 4 on the runners formed along fold lines 44*b* and 46*b*. As is seen in the breakaway view of FIG. 1, after insertion, outer riser sections 49 and 51 of each V-shaped leg are held parallel to the corresponding side wall panels 22 and 30 with which they make face to face contact. By making the height of outer riser sections 49 and 51 greater than the height of inner riser sections 45 and 47, respectively, the V-shaped legs are prevented from bending underneath central food support panel 38 and thereby defeating the insulating purpose of raising central food support panel 38 above bottom panel 26 of outer package 4, as described below. Furthermore, a space 39 between the inner and outer riser sections of each V-shaped support leg is created by spacing fold lines 44*a* and 46*a* apart by a distance which is slightly less than the horizontal distance between side wall panels 22 and 30 of outer package 4. Space 39 is a significant aspect of this invention since, by keeping the two riser sections of each leg out of direct contact, undesirable charring of the legs due to excessive heat being generated in the microwave cooking process is either eliminated or substantially reduced. It is also important to note that the interior side of inner top panel 34 is left intentionally uncoated by a microwave reflective material since the reflective coating is intentionally positioned on the top side of inner top panel 34. In this manner, panel 34 may act as a vapor absorptive material, thereby lessening the chance that food products cooked within container 2 will become soggy by reabsorption of moisture released during the cooking process.

Finally, the open end or ends of outer package 4 are closed. Lateral tabs 25 and 33 are folded along lines 25*a* and 33*a*, respectively, folding intermediate end flap 28 upwardly along line 28*a* and folding outer end flap 20 downwardly along line 20*a* to fold down automatically inner end flap 36 and to bring the lower portion of outer end flap 20 into face to face contact with intermediate end flap 28. An adhesive is applied either to intermediate end flap 28 or to outer end flap 20 or to both flaps prior to closing so that they remain in face to face contact. A similar operation is performed to close the other end of outer package 4 if this has not already been done.

Container assembly 2 is delivered to a customer as a sealed package containing frozen food such as a pizza. In order to use it, the customer tears off removable paperboard section 8 by placing a finger in either fingerhole 12, grasping section 8 with another finger and lifting simultaneously up and back across the container. In so doing, the several ventilation holes 10 are exposed. Container assembly 2 is then inserted into a microwave oven and cooked. During the cooking process, ventilation holes 10 allow water vapor to escape from the interior of the container assembly, thereby helping to prevent the cooking food from becoming overly moist or soggy. After cooking, container assembly 2 may be easily removed from the microwave oven by hand. By arranging inner food supporting tray 6 so that its central support panel 38 remains out of contact with bottom panel 26 of outer package 4, as described above, transfer of heat from the food and tray to the bottom panel is minimized, making the exterior of the container cooler and therefore more comfortable to handle by hand.

In order to serve the food within the container, the user grips tab 21 on tear away strip 14 and tears it back across closed outer end flap 20. After so doing, outer end flap 20, intermediate end flap 28, lateral tabs 25 and 33 and inner end flap 36 may be unfolded. Inner food supporting tray 6 is then removed by grasping barrier flap 40 or 42 and pulling inner food supporting tray 6 out of outer package 4. Tray 6 may then be used as a cutting surface for dividing the food into serving portions. Since the surface of the tray may be coated with a grease- and stick-resistant material, the food product may be easily removed and served either in one piece or in divided portions, as described above. Both outer package 4 and inner food supporting tray 6 are totally disposable, so that the customer may save or throw them away as desired.

Figure 9:
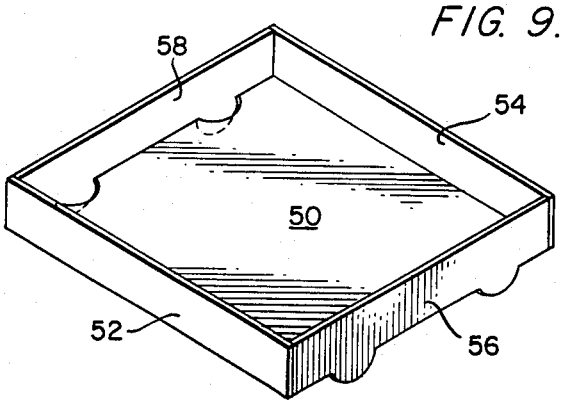
FIG. 9 is a perspective view of an erected food supporting tray formed from the blank of FIG. 8.

A flat single, unitary blank 48 for forming an alternative embodiment of the food supporting tray is shown in FIG. 8. This embodiment includes a central food support panel 50, two laterally opposed barrier flaps 52 and 54, and two laterally opposed leg flaps 56 and 58. This embodiment differs from the above-described preferred embodiment in that support legs for the central food support panel 50 are provided by popout legs formed from semi-circular cutouts 60 in panel 50. To erect this tray, barrier flaps 52 and 54 are folded upwardly. The popout legs are lowered by pressure on leg flaps 56 and 58 to cause leg flaps 56 and 58 to be folded upwardly along lines 56*a* and 58*a*, respectively, and to cause the popout legs to move into a downwardly projecting position relative to panel 50. This embodiment is particularly useful where small food support trays are desired and sauce spills are not a problem, since its assembly takes still fewer steps making it faster to assemble than the embodiment of FIGS. 5 and 6. The erected tray is depicted in perspective in FIG. 9.

Figure 10:
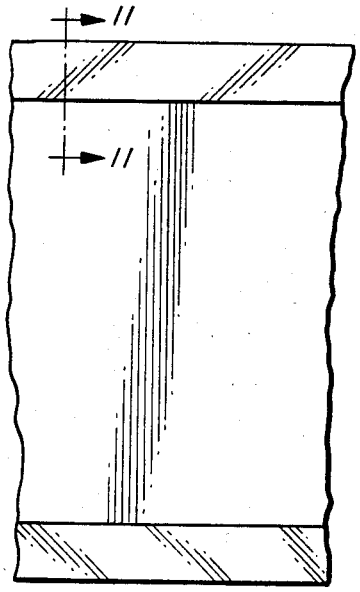
FIG. 10 is a cut away top view of paperboard stock for making the outer package of FIG. 3 showing shielding foil which has been strip laminated to the exterior lateral edges of the stock.
Figure 11:
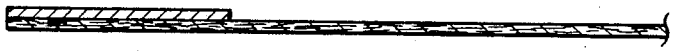
FIG. 11 is a fragmentary cross sectional view of line 11—11 of FIG. 10.

With regard to the microwave shielding material coating inner top panel 34, it is important to note that this invention also includes a novel method of applying such a coating. Application of the coating through high speed lamination to elongated paperboard stock is the most efficient and economical way to supply multiple paperboard blanks for the outer package. A problem arises when moving or stacking rolls of such paperboard stock for storage before it is used. If rolls are laminated only where two prospective blanks join each other in a width equal to twice the width of a single inner top panel, then the internal portions of a laminated roll will be thicker than the edges of the roll, thereby greatly increasing the risk of damage to the roll edges which are most likely to be struck during stacking or movement. Therefore, this invention discloses a novel method of laminating such rolls whereby lamination is applied to the exterior edge of each roll, as illustrated in FIG. 10. The elongated paperboard stock of FIG. 10 has a width sufficient to allow at least two rows of outer package blanks to be formed from the stock with the blanks being arranged in side by side relationship in the longitudinal direction of the paperboard stock with the coating receiving portions (inner top panels) of each blank in each row being positioned immediately adjacent a corresponding lateral edge of the elongated paperboard stock. This arrangement insures that when the elongated stock material is rolled up for movement or storage, the end portion of the stock rolls will be firm and capable of withstanding impact without damage. FIG. 11 further shows the difference in thickness between the laminated and unlaminated paperboard stock by depicting a fragmentary cross-section on line 11—11 of FIG. 10. By applying lamination to the edges of the elongated stock, the thickest part of the stock when rolled will be at the ends of the roll.

Figure 12:
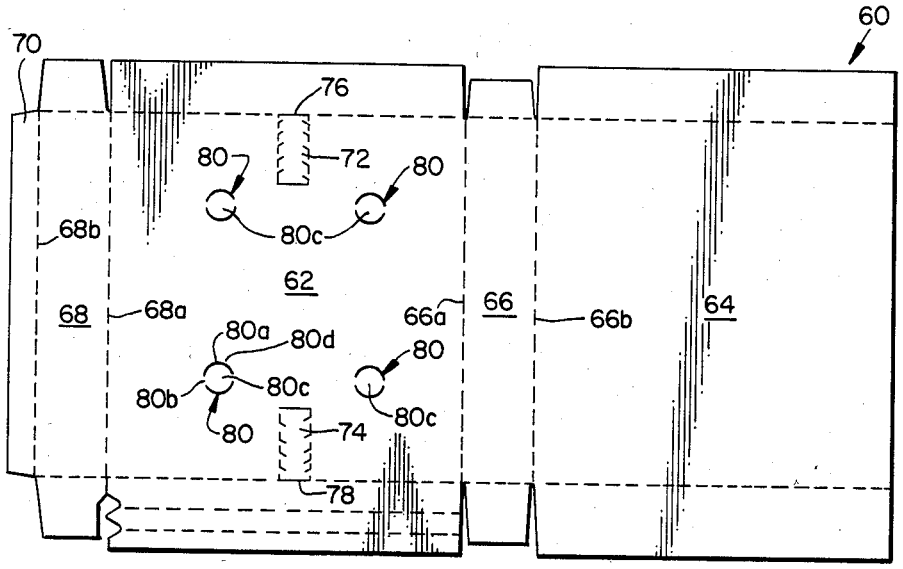
FIG. 12 is a top view of a paperboard blank for forming an alternative embodiment of the outer package of the subject invention.

In some instances it may be possible to eliminate the microwave reflective material and still obtain satisfactory cooking results. In FIG. 12, a paperboard blank 60 is illustrated for forming an alternative embodiment of an outer package designed in accordance with the subject invention without microwave reflective material. In this embodiment, the inner top panel of the embodiment of FIG. 2 has been eliminated. Like the embodiment of FIG. 2, blank 60 includes an outer top panel 62 and bottom panel 64. The top and bottom panels are connected to opposite edges of a side wall panel 66 along fold lines 66*a* and 66*b*, respectively. However, because the inner top panel has been eliminated, the second side wall panel 68 may now be connected to the opposite side of top panel 62 along a fold line 68*a*. A glue flap 70, connected to side wall panel 68 along fold line 68*b*, is used for attachment to the inside surface of bottom panel 64 to form a tubular shell as will be shown in Fig. 13. Blank 60 also includes a pair of relatively short tear strips 72 and 74 beginning adjacent slits 76 and 78, respectively, and extending inwardly toward one another for a short distance (approximately one inch). Alternately or together, four small holes or vent apertures 80 corresponding in size and position to holes 10 in inner top panel 34 of the blank of FIG. 2 could be formed in top panel 62 by substantially circular cuts 80*a* which leave a hinge forming uncut connection 80*b* joining the paperboard disk 80*c* within each hole 80 to the remaining portion of outer top panel 16. A small frangible connection 80*d* is formed by a short break in circular cut 80*a* opposite section 80*b*. Just before the container is placed in a microwave oven the disks 80*c* could be punched in by the user by breaking frangible connection 80*d* and bending the disks 80*c* inwardly along hinge connection 80*b* to open the vent holes or apertures. The disks 80*c* would remain connected to the outer top panel. The disks and/or tear out portions, thus, form removable closure portions for normally covering the vent apertures. In the alternate package as just described, a separate microwave reflective shield could be inserted as a second insert over tray 6. Such a reflective shield could take the form of a blank having an inverted U-shaped, vertical cross-section. In yet another alternative to the embodiment of FIG. 2, inner top panel 34 could be eliminated and the microwave reflective material could be laminated to panel 16 using any one of the vent aperture forming tecniques described above. While the reflective material could be placed on either the inside or outside of panel 16, it is preferable to place the material on the inside to avoid interference with the graphics which may be placed on the outside of the container.

Figure 13:
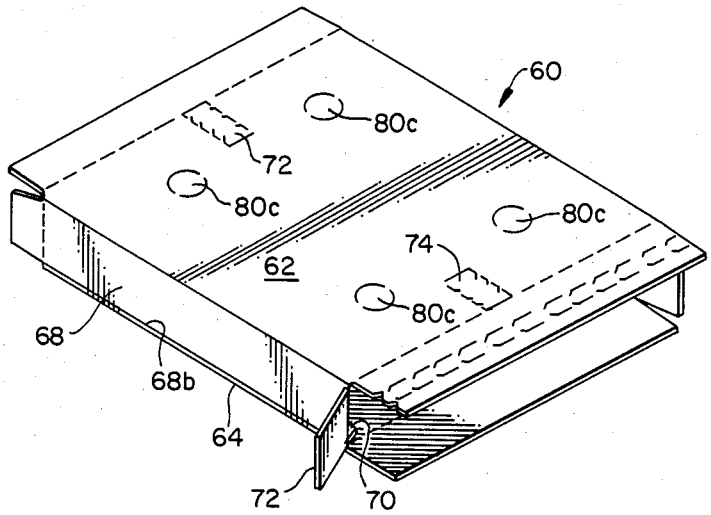
FIG. 13 is a perspective view of an erected outer package formed from the blank of FIG. 12.

FIG. 13 illustrates blank 60 as it would appear after the blank has been folded and glued to form a flattened tubular outer package and shipped to the point of packaging where it has been erected in preparation to receive a food supporting tray. In Fig. 13, one lateral tab 72 has been folded outwardly slightly to illustrate how flap 70 is folded along fold line 68*b* to engage the interior surface of bottom panel 64.

INDUSTRIAL APPLICABILITY

This invention has particular utility to the packaging of food products for distribution and sale in refrigerated display cases now common in most grocery stores. The disclosed container is ideally suited for packaging, shipping, vending microwave heating, and serving of food products, such as pizza, requiring partial shielding in a microwave oven and/or browning or crisping of the bottom surface of the food. The disclosed container could, however, be used for a wide variety of other prepared food products.

I claim:

1. A container for use in heating food in a microwave oven, comprising:

(a) outer package means constructed in a manner for containing and partially shielding food contained therein from microwaves and for providing an escape route for gas vapor generated during heating of the food; and (b) food supporting means for supporting the food and provided with a microwave interactive layer for converting microwave energy to heat so as to crisp a surface of the food supported thereon;

wherein said food supporting means is formed of a central food support panel flanked by at least a pair of leg flaps that are connected to the central food support panel by respective fold lines; wherein said food supporting means is temporarily convertible from a flat configuration into a non-self-sustaining support tray configuration having said leg flaps folded relative to said central food support panel in an manner providing support leg portions extending downwardly with respect to the central food support panel and wall portions extending upwardly relative thereto;

wherein said food supporting means is retainable in said support tray configuration within said outer package means solely by virtue of the relative size and configuration of the outer package means relative to that of said food supporting means when it is in said support tray configuration; and wherein said food supporting means is operative for converting back substantially into said flat configuration forming a cutting surface for the food when said food supporting means is removed, with the food thereon, from the outer packaging means after the food has been heated, due to the none-self-sustaining nature of said support tray configuration, wherein said leg flaps are laterally opposed multi-sectioned leg flaps, said laterally opposed multi-sectioned leg flaps being foldable into an upwardly open V-shape extending the length of side edges of said food support panel to which they are connected by said respective fold lines, so as to form supporting legs to raise said central food support panel above the bottom of said outer package means to insulate the bottom panel of the outer package means from heat generated during the microwave absorptive cooking process.

2. A container as defined in claim 1, wherein said central food support panel has a width dimension which is less than the width dimension of the outer package means in the plane of said central food support panel in order to permit said central food support panel to be erected into said support tray configuration and inserted into the outer package means without causing said sections of each of the V-shaped support legs to physically contact each other, thereby reducing the possibility of charring of said support legs.

3. A container as defined in claim 1, wherein the length of the outer section of each of the laterally opposed multi-sectioned leg flaps comprising the V-shaped support legs, when erected, approximately equals the vertical height of said outer package means to minimize movement of the food supporting means after it has been inserted into said outer package means and to assist in preventing the V-shaped support legs from deflecting to a position under the central food support panel.

4. A container as defined in claim 1, wherein the central food support panel is also flanked by a pair of reinforcing flaps that are connected thereto by respective fold lines, said reinforcing flaps being folded relative to the central food support panel for preventing bowing of the central food support panel under the weight of food supported thereon above a bottom wall of the outer package means.

5. A container as defined in claim 1, wherein said food supporting means is formed of a single unitary outer blank that is made from water vapor absorptive material to absorb water vapor emitted from the food during heating thereby preventing reabsorption of the water vapor by the food.

6. A container as defined in claim 1, wherein said microwave interactive layer means is coated with a stick and grease resistant layer.

7. A container according to claim 6, wherein said microwave interactive layer comprises a metallized layer of polyester film.

8. A container as defined in claim 1, wherein the entire upper surface of a single unitary inner paperboard blank forming said food supporting means is coated with a continuous layer of microwave absorptive material, which becomes heated when exposed to microwaves to crisp the surface of the food placed in contact therewith, as said microwave interactive layer.

9. A container as defined in claim 8, wherein the microwave absorptive material is coated with a grease resistant, heat resistant release coating to facilitate removal of food from said food supporting means after heating.

* * * * *